United States Patent [19]

Pozzebon

[11] Patent Number: 5,068,985

[45] Date of Patent: Dec. 3, 1991

[54] INNER SHOE PARTICULARLY FOR SKI BOOTS

[75] Inventor: Adolfo Pozzebon, Sala D'Istrana, Italy

[73] Assignee: Nordica S.p.A., Montebelluna, Italy

[21] Appl. No.: 441,016

[22] Filed: Nov. 24, 1989

[30] Foreign Application Priority Data

Dec. 2, 1988 [IT] Italy ..... 82614 A/88

[51] Int. Cl.[5] ..... A43B 5/04; A43B 23/07

[52] U.S. Cl. ..... 36/117; 36/71; 36/55

[58] Field of Search ..... 36/117–121, 36/71, 88, 89, 93, 92, 55

[56] References Cited

U.S. PATENT DOCUMENTS

| | | | |
|---|---|---|---|
| 294,020 | 2/1884 | Eisendrath | 36/55 X |
| 2,884,646 | 5/1959 | Alber | 36/71 |
| 3,239,952 | 3/1966 | Lange et al. | 36/119 |
| 3,798,799 | 3/1974 | Hanson et al. | 36/119 |
| 4,893,417 | 1/1990 | Dalla Lana | 36/119 X |
| 4,910,889 | 3/1990 | Bonaventure et al. | 36/117 |

FOREIGN PATENT DOCUMENTS

| | | | |
|---|---|---|---|
| 0022754 | 1/1981 | European Pat. Off. | 36/117 |
| 0086909 | 8/1983 | European Pat. Off. . | |
| 0309437 | 3/1989 | European Pat. Off. | 36/117 |
| 7141079 | 1/1972 | Fed. Rep. of Germany . | |
| 2311513 | 9/1973 | Fed. Rep. of Germany | 36/117 |
| 2107590 | 5/1972 | France . | |
| 2215784 | 8/1974 | France . | |

*Primary Examiner*—Paul T. Sewell
*Assistant Examiner*—Ted Kavanaugh
*Attorney, Agent, or Firm*—Guido Modiano; Albert Josif

[57] ABSTRACT

An inner shoe particularly usable in ski boots, includes a semi-rigid upper with which a lining is removably associable. The semi-rigid upper and the lining are provided with means for temporarily engaging respectively the lining and the semi-rigid upper. Reinforcement and protection elements are furthermore associable with the lining to increase the comfort of the user. The possibility of mutually disengaging the semi-rigid upper and the lining allows easy disassembling for washing or replacing the lining.

11 Claims, 1 Drawing Sheet

INNER SHOE PARTICULARLY FOR SKI BOOTS

BACKGROUND OF THE INVENTION

The present invention relates to an inner shoe particularly usable in ski boots.

It is in fact currently known to use, in said boots, inner shoes which, when arranged inside the boots, improve the skier's comfort.

Said known shoes are usually made of a single element, obtained by foaming or thermo-forming or by injection, in which the inner lining is inserted at the preset last which constitutes the mold.

After extraction, the inner shoe is finished by sewing the lining perimetrically thereto; said lining is folded for final finishing at the perimetric edges of the rear opening of said inner shoe.

However, the manufacturing of said known kinds of inner shoe has considerable disadvantages: first of all the lining must be waterproofed before the last of the mold is inserted, and then a further waterproofing must be performed after the sewings have been provided.

After the opening of the mold there are several rejects caused by a not optimum placement of the last.

Finally, a considerable disadvantage is noted due to the fact that, after skiing, the inner shoe becomes very damp inside, forcing the skier to extract it to dry it.

Said known kinds of inner shoe also have further disadvantages when the boots are rented to several skiers: in this case the problem of hygiene in the use of said inner shoes arises, since mycoses may be transmitted and the inside of the inner shoe cannot be washed easily in any case, forcing the renters to possible periodic replacements.

SUMMARY OF THE INVENTION

The aim of the present invention is therefore to eliminate the disadvantages described above in known types by providing an inner shoe for ski boots which besides having modest manufacturing costs and assembly times can be easily cleaned and/or washed internally.

Within the scope of the above described aim, another important object is to provide an inner shoe which can be easily replaced at a modest cost.

Another important object is to provide an inner shoe which associates with the preceding characteristics that of being custom made, since it may have aesthetic differentiations without having to undergo particular and specific production steps.

The above described aim and objects and others which will become apparent hereinafter are achieved by an inner shoe particularly for ski boots, characterized in that it comprises a semi-rigid upper, with which a lining is removably associable, said semi-rigid upper and said lining having means for their temporary mutual engagement, reinforcement and protection elements being associable with said lining.

BRIEF DESCRIPTION OF THE DRAWINGS

Further characteristics and advantages will become apparent from the detailed description of two particular but not exclusive embodiments, illustrated only by way of non-limitative example in the accompanying drawings, wherein.

DESCRIPTION OF THE PREFERRED EMBODIMENTS

Figure 1:
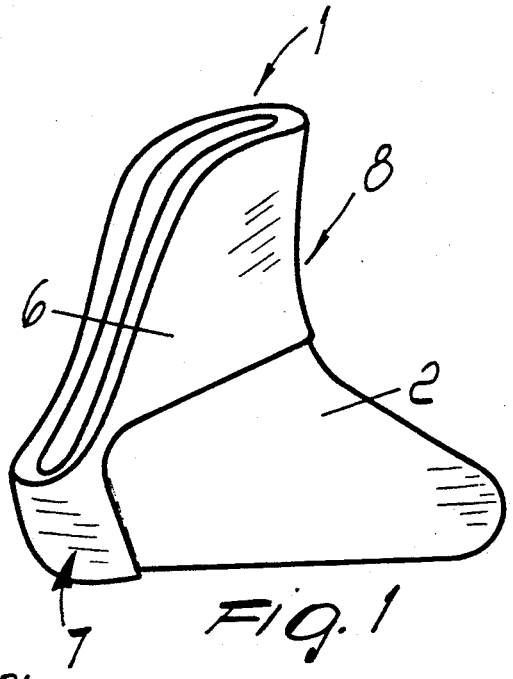
FIG. 1 is a perspective view of the assembled inner shoe.
Figure 2:
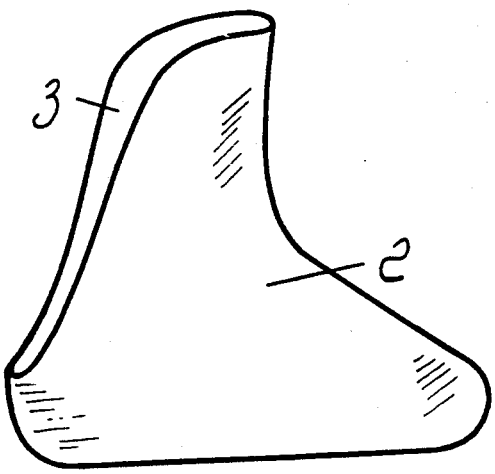
FIG. 2 is a view, similar to the preceding one, of the semi-rigid upper alone.
Figure 3:
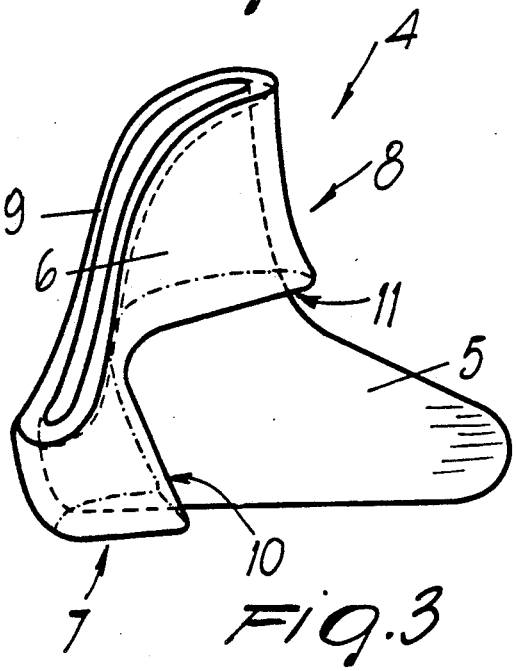
FIG. 3 is a view, similar to the preceding one, of the lining alone.

With reference to the figures, the reference numeral 1 indicates an inner shoe, particularly usable in ski boots, which can be constituted by a semi-rigid upper 2 optionally provided with a rear opening 3.

Said upper 2 is thus self-supporting and can be obtained by foaming, thermo-forming or by using expandable material.

In this last case, a base product such as ethyl vinyl acetate, optionally mixed with rubber and with expanding material, may be used; the mixture is thus subsequently injected into a mold, which is brought to a certain temperature to allow the expanding agent to volatilize and is kept at that temperature for the curing of the product.

This process allows the inner shoe to expand immediately up to the required dimensions when the mold is opened; the mold has very small dimensions with respect to the final product's required dimensions.

The use of the above mentioned material provides a perfectly waterproof semi-rigid upper having a given degree of elasticity and functioning as padding.

A lining, generally indicated by 4, furthermore contributes to constitute the inner shoe 1, and comprises a first part 5 which is shaped complementarily to the inside of the upper 2 and a second part 6, fixed outside the first, which constitutes a means for temporary engagement with said upper 2.

Said second part 6 in fact constitutes an outer covering for the first part 5 and predominantly affects the region 7 of the heel and the region 8 adjacent to the foot instep; the coupling between the first part and the second part occurs, for example, by sewing at the perimetric edge 9 of the lining adjacent to the rear opening 3 of the upper 2.

A first seat or cavity 10 and a second seat or cavity 11 are thus defined between the first part and the second part, and the complementarily shaped regions of the upper 2 can be inserted therein.

The second part 6 may advantageously be constituted by elasticized material.

Protection elements may furthermore be associated inside the first part 5 to increase the inner shoe comfort.

The use of said inner shoe is in fact as follows: once the upper 2 has been obtained, it is sufficient to fit said upper inside the first and second seats defined on the lining 4 by pushing the first inner part thereof to adhere inside the upper 2 by simple manual placement.

After skiing, the skier may extract the inner shoe from the boot, disengaging the lining from the upper and subsequently drying or washing said lining.

It has thus been observed that the invention achieves the intended aim and objects, an inner shoe having been provided which makes the boot assembling very simple with the possibility of disengaging the lining from the upper, for example, to wash said lining.

In the assembling, suitable internal protection elements may be furthermore associated with the lining, for example at the malleolar region.

Besides the fact that the removal of the lining is very easy, said lining may be replaced at very low costs, and the upper can be used in any case.

The interchangeability of the lining furthermore allows to customize the inner shoe, since the second part may for example be colored differently from the first.

The invention is naturally susceptible to numerous modifications and variations, all of which are within the scope of the same inventive concept.

Figure 5:
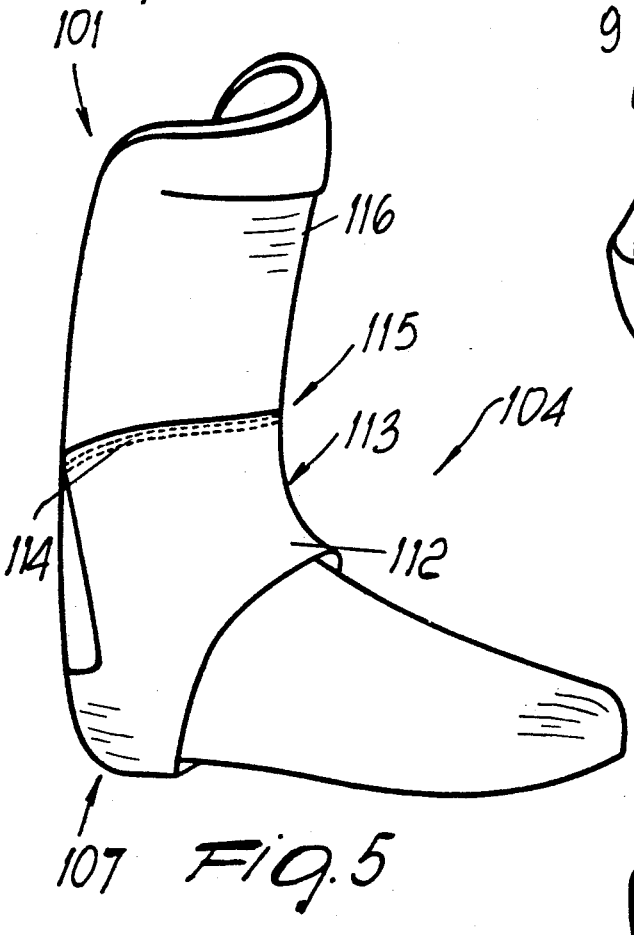
FIG. 5 is a lateral perspective view of a second embodiment.
Figure 4:
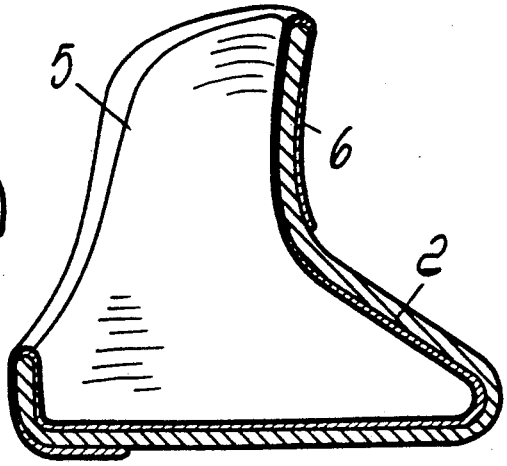
FIG. 4 is a sectional view, taken along a longitudinal middle plane, of the inner shoe of FIG. 1.

Thus, for example, FIG. 5 illustrates a second embodiment of an inner shoe 101 of a ski boot which again comprises a semi-rigid upper (not illustrated in the figure for the sake of clarity) and a lining 104.

Said lining has means for engaging with said semi-rigid upper, constituted by an elasticized gaiter 112 which embraces the region 107 of the heel and the region 113 of the foot instep and is associated with the lining by means of a seam 114 which transversely affects said lining at the tibial region 115.

The gaiter 112 naturally embraces the lining 104 so as to allow their temporary mutual coupling.

Protection elements, such as for example a collar 116, advantageously sewn to the lining together with the elasticized gaiter, may furthermore be associated with the lining 104.

The means for the mutual engagement between said upper and said lining may naturally be different, such as for example preset strips of material commercially known by the trade-mark "Velcro" sewn to the lining or to the semi-rigid upper.

The materials which constitute the upper or the lining and the reinforcement and protection elements, as well as the dimensions, may naturally also be the most pertinent according to the specific requirements.

I claim:

1. Inner shoe particularly for ski boots, comprising a semi-rigid upper with which a lining is removably associated, at least one of said semi-rigid upper and said lining having means for their mutual temporary engagement, said lining comprising a first part which is shaped complimentarily to the inside of said semi-rigid upper and a second part which is arranged outside said first part and constitutes said means for temporary engagement with said semi-rigid upper, said second part embracing said first part at the region of the heel and at the region adjacent to the foot instep.

2. Inner shoe particularly for ski boots, comprising a semi-rigid upper with which a lining is removably associated, at least one of said semi-rigid upper and said lining having means for their mutual temporary engagement, said lining being adapted to have associated therewith reinforcement and protection elements, said lining comprising a first part which is shaped complimentarily to the inside of said semi-rigid upper and a second part which is arranged outside said first part and constitutes said means for temporary engagement with said semi-rigid upper, said second part embracing said first part at the region of the heel and at the region adjacent to the foot instep.

3. Inner shoe according to claim 2, wherein at least one seat is defined between said first part and said second part, a complimentarily shaped region of said semi-rigid upper being arrangeable in said at least one seat.

4. Inner shoe according to claim 2, wherein said second part is constituted by elasticized material associated with said first part at at least one point.

5. Inner shoe according to claim 2, wherein said protection means comprises at least one layer of soft material arrangeable at said lining.

6. Inner shoe according to claim 2, wherein said means for the temporary mutual engagement of said lining and said semi-rigid upper comprises an elasticized gaiter which externally embraces the region of the heel and the region of the foot instep, said gaiter being associated with said lining by means of a seam which transversely affects a tibial region.

7. Inner shoe according to claim 6, wherein a seat for coupling to said semi-rigid upper is defined between said gaiter and said lining.

8. Inner shoe according to claim 2, wherein said reinforcement and protection elements comprise a collar associated with said lining at the tibial region.

9. Inner shoe according to claim 2, wherein said semi-rigid upper is obtained by foaming.

10. Inner shoe according to claim 2, wherein said semi-rigid upper is obtained by thermo-foaming.

11. Inner shoe according to claim 2, wherein said semi-rigid upper is obtained by injection molding.

* * * * *